United States Patent [19]

Franklin et al.

[11] 4,184,701

[45] Jan. 22, 1980

[54] TAMPER PROOF LABEL

[75] Inventors: Priscilla S. Franklin; Frederick L. Jones, both of Dayton, Ohio

[73] Assignee: Monarch Marking Systems, Inc., Dayton, Ohio

[21] Appl. No.: 876,761

[22] Filed: Feb. 10, 1978

[51] Int. Cl.[2] ..... B42D 15/00

[52] U.S. Cl. ..... 283/9 R; 40/2 R; 156/279; 156/344; 283/8 R; 427/7; 427/207 C; 428/916

[58] Field of Search ..... 283/8 R, 6, 8 A, 8 B, 283/9 R, 21; 40/2.2, 2 R; 229/83; 428/203, 201, 40, 916; 427/7, 207 C; 156/279, 344

[56] References Cited

U.S. PATENT DOCUMENTS

| | | | |
|---|---|---|---|
| 3,364,049 | 1/1968 | Peak et al. | 283/8 R X |
| 3,631,617 | 1/1972 | Pekko | 40/2.2 |
| 3,864,855 | 2/1975 | Pekko | 40/2 R |
| 4,057,919 | 11/1977 | Gauch et al. | 40/2.2 |
| 4,082,873 | 4/1978 | Williams | 283/9 R X |
| 4,121,003 | 10/1978 | Williams | 40/2.2 X |

FOREIGN PATENT DOCUMENTS

| | | | |
|---|---|---|---|
| 2509178 | 9/1976 | Fed. Rep. of Germany | 40/2 R |
| 2613131 | 10/1977 | Fed. Rep. of Germany | 40/2.2 |

*Primary Examiner*—William R. Briggs

*Attorney, Agent, or Firm*—Jones, Tullar & Cooper

[57] ABSTRACT

This invention relates to tamper-proof labels useful for marking objects in a manner such that, if one were to attempt to transfer the label to another object, the label would be destroyed or defaced to such an extent that its transference would be noticeable.

The label comprises a laminate comprising a transparent or translucent outer sheet having an information containing pattern printed on its inner surface, said printed film having a discontinuous coating of transparent plasticized organic polymeric material thereon, with said printed and coating surface having a coating of a color containing pressure sensitive adhesive film thereon. The plasticizer in said organic polymeric material being a non-reactive, migrating plasticizer, which is also a plasticizer for said pressure sensitive adhesive.

Once applied to a substrate, if removal of the label is attempted, the label delaminates in a manner such that at least portions of the colored adhesive in register with the transparent discontinuous plasticized polymer coating remain on the substrate to which the label has been adhered resulting in a label which has a visually perceptible tamper-indicating change in at least portions of its background color.

In a preferred embodiment the free side of the adhesive film of the label is covered by a release sheet.

5 Claims, 3 Drawing Figures

TAMPER PROOF LABEL

BACKGROUND OF THE INVENTION

Objects are frequently marked or identified with the intention that the marking be either "permanent" or uniquely characteristic of the object or objects so marked. Examples of such markings include ownership information, serial numbers, licenses, permits, statutorily required information, and certification that an object possesses certain characteristics or conforms to certain statutory requirements.

Various methods are employed to achieve these results. The use of relatively convenient and inexpensive labels presents problems in that, if the label can be switched from one object to another, in a manner that is not readily detectable, the validity of the information contained on the label is subject to question.

SUMMARY OF THE INVENTION

This invention relates to tamper-proof labels useful for marking objects in a manner such that, if one were to attempt to transfer the label to another object, the label would be destroyed or defaced to such an extent that its transference would be noticeable.

The label comprises a laminate comprising a transparent or translucent outer sheet having an information containing pattern printed on its inner surface, said printed film having a discontinuous coating of transparent plasticized organic polymeric material thereon, with said printed and coating surface having a coating of a color containing pressure sensitive adhesive film thereon. The plasticizer in said organic polymeric material being a non-reactive, migrating plasticizer, which is also a plasticizer for said pressure sensitive adhesive.

Once applied to a substrate, if removal of the label is attempted, the label delaminates in a manner such that at least portions of the colored adhesive in register with the transparent discontinuous plasticized polymer coating remain on the substrate to which the label has been adhered resulting in a label which has a visually perceptible tamper-indicating change in at least portions of its background color. Preferably, at least a portion of the adhesive not in register with the plasticized polymer coating is retained on the label.

In a preferred embodiment the free side of the adhesive film of the label is covered by a release sheet.

DESCRIPTION OF THE PREFERRED EMBODIMENTS

Figure 1:
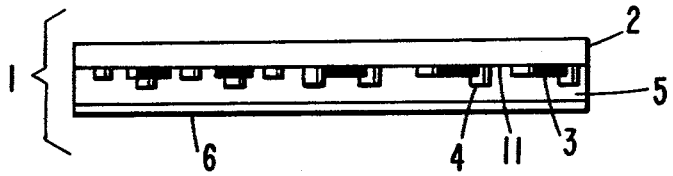
FIG. 1 is a schematic representation of the label of the invention with a release sheet in place.

With reference to FIG. 1, the label of the invention 1 comprises an external layer of flexible transparent or translucent plastic film 2. The film has sufficient transparency or translucency so that an information containing pattern printed on one side is visible through the film. The chemical nature of the plastic film is not critical, so long as it has sufficient film integrity for its intended use, and provides a surface which has appropriate ink and adhesive affinity characteristics, as set forth hereinafter. Preferred films include polyester films, such as condensation products of terephthalic acid and a glycol, such as ethylene glycol; isophthalic acid and a glycol; or mixtures of terephthalic acid, isophthalic acid and a glycol. A particularly useful film of this type is a highly oriented polyester film known in the trade as "Mylar" film, which has been "print treated", i.e. coated or processed in a known manner to increase its ink receptiveness. Other useful polymer films include films of acrylic polymers and interpolymers; cellulosic polymers, including cellulose acetate, cellulose acetate butyrate, cellulose acetate propionate and mixtures thereof; polyolefins, including homopolymers and interpolymers of ethylene or propylene; polystyrene, polycarbonates, and vinyl chloride polymers and interpolymers, including such polymers compounded with property modifying agents such as those known in the film art; as well as surface treated or coated films of such polymers, treated, for example, to make them more ink receptive.

On the interior surface 11 of the exterior film 2 there is reverse printed an information containing pattern 3 (thickness exaggerated in the drawing) of letters, numbers, words, designs, code bars or other forms of human or machine readable information. The method of printing is not critical and can be any printing process useful in printing upon plastic films including flexograhic, letterpress and gravure printing techniques.

The chemical composition of the ink employed to print the pattern 3 is not critical, however, the ink must produce a printed pattern which adhers sufficiently to the outer film to allow for lamination.

A particularly useful ink is a flexographic letterpress ink consisting of 10% of a phthalocyan blue light-fast dye and 90% of 10:80 resin-vehicle mixture, where the resin is quarter-second nitrocellulose and the solvent consists of (by weight) 40% denatured ethyl alcohol, 30% ethylene glycol monoethylether, and 30% n-propyl acetate.

In a preferred embodiment of the invention, 2 mil Mylar film print treated was reverse printed with the above ink and the printing dried by 140° F. force air through a slit nozzle ½ inch away from the printed side of the film.

Figure 2:
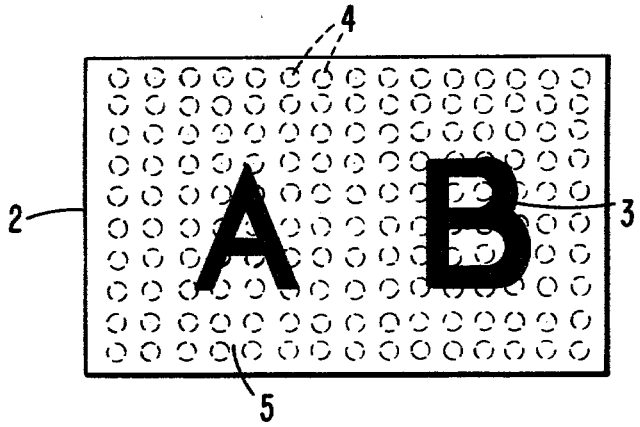
FIG. 2 is a representation of the label of the invention as viewed upon an object.

The printed film is then coated with a discontinuous coating of a transparent, substantially colorless coating of a plasticized organic polymeric material 4. The pattern of the discontinuous coating can vary substantially. Preferrably, the discontinuous coating is applied in a substantially uniform pattern over the total surface area of the sheet to provide a plurality of non-connected coating areas. It has been noted that a large number of relatively small coating areas are preferred to a lesser number of larger areas. Circular areas appear to produce the best results, apparently due to the large effective edge presented by such a pattern. With plasticized ethyl cellulose small circles of approximately ⅛ inch in diameter, separated from each other by an equal distance (⅛ inch), are preferred. Such an arrangement is represented in FIG. 2 where the discontinuous coating 4 is uniformly distributed behind the outer sheet 2 and the printed pattern 3.

The method of applying the discontinuous coating 4 to the printed outer sheet can be any conventional coating technique adapted to apply the particular plasticized polymeric material employed to the particular substrate employed. For example, the presently preferred method employed to deposit plasticized ethyl cellulose on the printed sheet is by flexography, in the same manner as the information bearing ink pattern 3 was deposited.

The resultant printed and coated film is then coated on its printed/coated side with a layer of pressure sensitive adhesive 5. The chemical composition of the adhesive layer is not critical so long as the adhesive layer will adhere sufficiently to the film 2 to provide a unitary laminate, but will adhere more strongly to the article to which the label is affixed than an internal bond in register with the discontinuous plasticized polymer coating; so that, when removal of the label from the article is attempted, the adhesive layer or at least that portion thereof in register with the discontinuous polymer coating will remain adhered to the substrate. The internal bond at which the label delaminates may be the bond between the discontinuous film and the ink, where present; the bond between the outer sheet and the discontinuous film; and/or the bond between the outer sheet and the ink, where present. As indicated, one or more of these bond failures occur in the areas in register with the plasticized discontinuous coating. Apparently the migrating plasticizer functions in some manner, such as migrating from the discontinuous coating into one or more of the materials adjacent thereto or into the interface between materials to affect the bond strength of that material. In a preferred embodiment the adhesive is selected such that at least a tamper indicating amount thereof adheres to the label upon removal in areas other than the areas in register with the plasticized discontinuous film where the adhesive, the discontinuous film and the ink, where present, substantially remain adhered to the article to which the label had been applied.

A particularly useful pressure sensitive adhesive, useful in conjunction with the ink and plasticized ethyl cellulose, described above, is a 43% solids solution of white pigmented ($TiO_2$) acrylic solution polymer (Pierce and Stevens Hybond F 9515 X-10), having a viscosity (77° F.) of 80,000 cps at 25° C., cut with ethyl acetate as required for coating. Representative physical data of a 1 mil dry film of this adhesive applied to a Mylar film (air dried) are as follows:

Quick stick (rolling ball-incline plane)
(Inches of Fall)/(Inches of Travel)+1.5
75+2° F. Creep ($1\times\frac{1}{2}$ inch adhesive strip attached at the vertical to stainless steel plate, 1000 gm wt) 20+ hours
Williams Plastometer (150° F.)=1.38

The pressure sensitive adhesive layer is colored by the use of dyes or pigment so as to provide a color contributing background, for example as 5 in FIG. 2, visible through the outer sheet 2.

The organic plasticizer, the organic polymer material in the discontinuous film and the pressure sensitive adhesive are selected such that the plasticizer is both a plasticizer for the organic polymeric material and a plasticizer for the pressure sensitive adhesive. Most preferably the plasticizer is also a plasticizer for the printed pattern. The plasticizer is selected to be a nonreactive external plasticizer which is capable of migration from the organic polymeric material into the pressure sensitive adhesive; and preferably, also capable of migration into the printed pattern. If desired, a mixture of plasticizer can be employed. For an extensive discussion of plasticizers, their compatability with particular resins and their migratory properties see Kirk-Othmer "Encyclopedia of Chemical Technology" 2nd Ed., *Plasticizers* Vol. 15, pages 720–789. There appears no need to completely reiterate the data contained therein here, and selection of any particular unitary system can readily be made by consulting this, or other standard text on plasticizers.

The presently preferred system comprises a print treated Mylar outer sheet, the nitrocellulose ink described above and the acrylic adhesive described above, used in conjunction with a transparent plasticized discontinuous coating which comprises 45% ethyl cellulose (N-20 Dow Ethocel) and 55% by weight of butyl oleate. This transparent plasticized polymer composition is preferably applied in the pattern described above as an 11% solids solution from a solvent comprising 40% denatured ethyl alcohol, 30% ethylene glycol monoethyl ether and 30% n-propyl acetate.

The amount of plasticizer employed to in the organic polymeric material is a coating compatible amount at least sufficient to provide for adjacent area adhesion modifying migration of plasticizer from the organic polymeric coating material.

Figure 3:
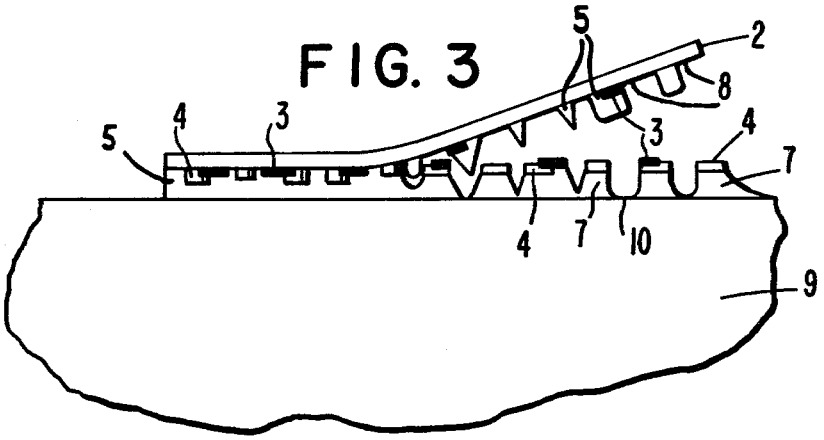
FIG. 3 is a representation of the label, upon an object, in a state of partial delamination.

The effects by the use of the presently preferred label of the invention are depicted schemetrically in FIG. 3. Upon attempted removal from an article, the label delaminates in a manner such that the colored adhesive layer 5, at least in areas 7 where it had been in contact with the plasticized discontinuous coating 4, remains adhered to the substrate 9; leaving areas 8 which have no adhesive color or at least sufficiently reduced adhesive color to give visual indication, when the label is viewed through the outer sheet, that the label has been tampered with. In addition, holes 10 are created in the colored adhesive layer remaining on the substrate giving visual indication of tampering.

While in the embodiment described in detail, the adhesion properties of the elements of the laminate are chosen so that substantially all or at least a tamper indicating amount of the ink is removed on the outer sheet upon which it was originally printed in the areas in register with the discontinuous plasticized coating, inks and adhesives can be employed where the relative adhesion properties are such, that substantialy none of the printing is removed from the film on which it was originally printed. In other words, the relative adhesion properties of the elements of the laminate can be chosen so that, upon delamination, any desired proportion of the ink adheres, respectively, to the adhesive layer and to the outer layer, so long as a tamper indicating amount of the colored adhesive remains adhered to the article. Preferably, the adhesive is chosen so that it is proportioned between the top sheet and the article upon delamination.

In yet another embodiment, the information containing pattern can be printed on the inner surface of the outer layer of the label with at least two inks having significantly different adhesion characteristics, so that, upon subsequent delamination of the label, a first ink adheres exclusively or primarily to the outer layer, while a second ink is removed from the outer layer upon which it was originally printed and adheres exclusively or primarily to the adhesive layer.

While the relative thickness of the various layers in the laminate is not unduly critical and is primarily dictated by economics and the properties desired for a particular use, typically, the outer film layer 2 will have a thickness of between about 0.5 mil and about 6 mils, while the adhesive layer will have a thickness between about 0.3 mil and about 3 mils.

To further exemplify the invention in one embodiment, the pressure sensitive adhesive layer adhered to the object to which it is affixed with a bond strength of about 26.4 ounces per inch width at 90° peel, and 32 ounces per web width at 180° peel, while the bond strength between the Mylar and the panel was about 24 ounces per inch width with a dot pattern of the ethyl cellulose on the Mylar. The bond strength between the adhesive layer and the release paper is typically about 1 ounce (PSTC-1).

With reference to FIG. 1, in order that the label can be handled and stored more readily, for example, individually, in a rolled tape form, or a flexible sheet form, the object adhering surface of the label 1 can be temporarily covered with a relase sheet 6, of the type conventionally known in the art, for example, a silicone treated release paper. In a preferred embodiment the release paper is a semi-bleached release paper coated on its adhesive contacting side with a silicone release agent. As is conventional, the release agent is elected with a tight enough release level to allow the label to be conveyed to the object being labeled without premature separation of the release sheet, but with a release level low enough so that the release sheet can be readily intentionally removed to expose the adhesive layer for bonding when desired. The release level should be lower than the level of adhesion of the ink to the outer sheet to prevent delamination of the label upon removal of the release sheet.

While there has been described, above, the invention and what are now considered its best embodiments, it is understood that other materials, such as are known in the art or described, above, may be substituted for those exemplied. All parts and percentages set forth above are by weight unless otherwise specified.

What is claimed is:

1. A laminated label comprising:

(a) a flexible transparent or translucent plastic film, (b) having reverse printed on one side thereof an information containing pattern, (c) a discontinuous coating of a substantialy colorless plasticized organic polymeric coating upon the printed side of said printed plastic film, and (d) a colored layer of pressure sensitive adhesive bonded to said printed and coated side of said film, said layer contacting said printed pattern, said coating, and said film, (e) the plasticizer in said polymeric coating being selected such that it is a plasticizer for both said coating and said adhesive, with said plasticizer being present in an amount sufficient to migrate from said coating to affect the bond strength of at least portions of said adhesive layer adjacent said discontinuous coating, (f) said adhesive being an adhesive which will adhere more strongly to an object upon which the label will be mounted than to an internal laminate bond in register with the discontinuous plasticized polymeric coating, (g) so that when the laminated label has been mounted upon said object, attempted removal will cause delamination so that at least a tamper indicating amount of the colored adhesive layer remains adhered on the object in the areas opposed to areas where the adhesive layer contacts the discontinuous plasticized coating.

2. A label as in claim 1 where the flexible plastic film is a print treated ethyleneterephthalate polymer and the plasticized organic polymeric coating is plasticized ethyl cellulose.

3. A label as in claim 2 where the colored pressure sensitive adhesive is selected such that when the label is applied to said object the relative adhesion properties between the elements of the laminate are such that upon attempted removal the label delaminates with at least a portion of the adhesive remaining adhered to the flexible plastic film while a tampering indicating amount of said adhesive in register with said discontinuous coating remains upon the object.

4. A method of forming a label which comprises:

(a) reverse printing an information containing pattern on one side of a flexible transparent or translucent plastic film, (b) applying a discontinuous coating of a substantially colorless plasticized organic polymeric coating upon the printed side of said printed plastic film, and (c) bonding a layer of colored pressure sensitive adhesive to the printed and coated side of said film, to contact said information containing pattern, said coating and said film, (d) the plasticizer in said polymeric coating being selected such that it is a plasticizer for both said coating and said adhesive with said plasticizer being present in an amount sufficient to migrate from said coating to affect the bond strength of at least portions of said adhesive layer adjacent said discontinuous coating, (f) said adhesive being an adhesive which will adhere more strongly to an object upon which the resultant label will be mounted than to an internal laminate bond in register with the discontinuous plasticized polymeric coating, (g) so that when the resultant laminated label has been mounted upon, said object attempted removal will cause delamination so that at least a tamper indicating amount of the colored adhesive layer remains adhered on the object in areas opposed to areas where the adhesive layer contacts the discontinuous plasticized coating.

5. A method as in claim 4 where the colored pressure sensitive adhesive is selected such that when the label is applied to said object the relative adhesion properties between the elements of the laminate are such that upon attempted removal the label delaminates with at least a portion of the adhesive remaining adhered to the flexible plastic film while a tampering indicating amount of said adhesive in register with said discontinuous coating remains upon the object.

* * * * *